US006082081A

United States Patent [19]

Mucha

[11] Patent Number: 6,082,081

[45] Date of Patent: Jul. 4, 2000

[54] POWERED PRESTRETCHED FILM DELIVERY APPARATUS

[76] Inventor: Jacek Mucha, 2270 Industriel, Laval, Quebec, Canada, H7S 1P9

[21] Appl. No.: 09/113,537

[22] Filed: Jul. 10, 1998

[51] Int. Cl.[7] ..... B65B 53/00

[52] U.S. Cl. ..... 53/556; 425/66

[58] Field of Search ..... 53/556, 441; 425/66, 425/367

[56] References Cited

U.S. PATENT DOCUMENTS

| | | | |
|---|---|---|---|
| 3,019,573 | 2/1962 | Navikas | 53/27 |
| 3,921,973 | 11/1975 | Kitagawa et al. | 271/172 |
| 4,302,920 | 12/1981 | Lancaster et al. | 53/556 |
| 4,387,548 | 6/1983 | Lancaster et al. | 53/399 |
| 4,413,463 | 11/1983 | Lancaster | 53/556 |
| 4,496,417 | 1/1985 | Haake et al. | 156/361 |
| 4,497,159 | 2/1985 | Lancaster, III | 53/556 |
| 4,514,955 | 5/1985 | Mouser et al. | 53/64 |
| 4,541,225 | 9/1985 | Byland | 53/441 |
| 4,590,746 | 5/1986 | Humphrey | 53/556 |
| 4,767,578 | 8/1988 | Thimon | 264/40.1 |
| 5,081,824 | 1/1992 | Thimon et al. | 53/556 |
| 5,195,296 | 3/1993 | Matsumoto | 53/399 |
| 5,414,979 | 5/1995 | Moore et al. | 53/556 |
| 5,581,979 | 12/1996 | Scherer | 53/441 |
| 5,715,655 | 2/1998 | Söderburg | 53/441 |
| 5,875,616 | 3/1999 | Paavola et al. | 53/556 |

*Primary Examiner*—Linda Johnson
*Attorney, Agent, or Firm*—Zarley, McKee, Thomte, Voorhees & Sease; Dennis L. Thomte

[57] ABSTRACT

A prestretch roller assembly for a film delivery system includes upstream and downstream prestretch drive rollers for engaging and stretching a stretch film web. The web extends around an upper portion of the upstream drive roller and thence directly to a lower portion of the downstream drive roller, to form a generally S-shaped path. The downstream drive roller is rotatably mounted on a stationary frame, and the upstream drive roller has one end rotatably connected to the stationary frame and a second end rotatably connected to a swing frame. An upstream idler roller is rotatably mounted on the stationary frame upstream of the upstream drive roller, and a downstream idler roller is rotatably mounted from the swing frame downstream of the downstream drive roller. The axes of all four rollers are coplanar when the swing frame is moved to a closed position.

11 Claims, 4 Drawing Sheets

POWERED PRESTRETCHED FILM DELIVERY APPARATUS

TECHNICAL FIELD

The present invention relates generally to stretch wrapping apparatus, and more particularly to a stretch wrapping apparatus with prestretch rollers which stretch packaging material prior to delivery to a load to be wrapped.

BACKGROUND OF THE INVENTION

Stretch wrapping is a packaging technique which dispenses a sheet of stretch wrap packaging material in a stretched condition around a load, to cover and retain the load in a packaged condition. Current stretch wrapping apparatus utilize film dispensers having two closely spaced rollers to stretch a web of thermoplastic stretch film packaging material. These rollers are known as prestretch rollers, with a downstream roller having a faster surface speedy than an upstream roller. This differential in surface speeds between the downstream and upstream rollers stretches the packaging material between the prestretch rollers in the dispensing direction.

Typically, the prestretch rollers were equal in diameter, and powered, such that the downstream prestretch roller had a faster surface speed than the upstream prestretched roller, to thereby stretch the web of stretch film over its yield point in the dispensing direction.

Preferably, the upstream and downstream prestretched roller should be closely spaced together during operation to prevent "neck down" (lost of film width) of the film web as it is being stretched in the dispensing direction.

Another desirably feature is to reduce or eliminate theoretical elongation of the stretch film. This is achieved by increasing the amount of surface contact of the stretch film with the prestretch rollers. The conventional path of stretch film around the prestretch rollers affords approximately one quarter of the circumference of the roller in contact with the stretch film.

Finally, it is desirable to achieve are liable elongation of the stretch film, which allows slight film imperfections to base through the system without causing a film failure.

SUMMARY OF THE INVENTION

The prestretch roller assembly for a film delivery system of the present invention includes upstream and downstream prestretch drive rollers for engaging and stretching a stretch film web. The web extends around an upper portion of the upstream drive roller and thence directly to a lower portion of the downstream drive roller, to form a generally S-shaped path. The downstream drive roller is rotatably mounted on a stationary frame, and the upstream drive roller has one end rotatably connected to the stationary frame and a second end rotatably connected to a swing frame. An upstream idler roller is rotatably mounted on a the stationary frame upstream of the upstream drive roller, and a downstream idler roller is rotatably mounted from the swing frame downstream of the downstream drive roller. The axes of all four rollers are coplanar when the swing frame is moved to a closed position.

It is therefore a general object of the present invention to provide an improved powered prestretch film delivery system.

Another object is to provide a prestretch film delivery system which reduces the stretch distance between the prestretched rollers, and thereby reduces neck down of the stretch film.

A further object of the present invention is to provide an improved prestretch delivery system with enhanced film traction.

Yet another object is to provide a powered prestretch film delivery system which is able to more reliably elongate the stretch film to allow slight film imperfections to pass through the system without causing a film failure.

These and other objects will be apparent to those skilled in the art.

DESCRIPTION OF THE PREFERRED EMBODIMENT

Figure 1A:
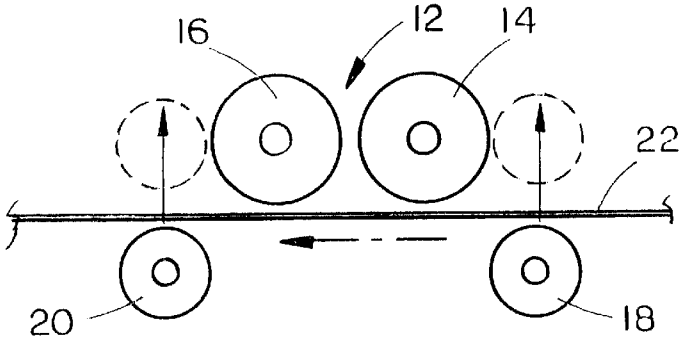
FIG. 1A (PRIOR ART)
FIG. 1A is a schematic view of a prior art system with the rollers in the open, film threading position.
Figure 1B:
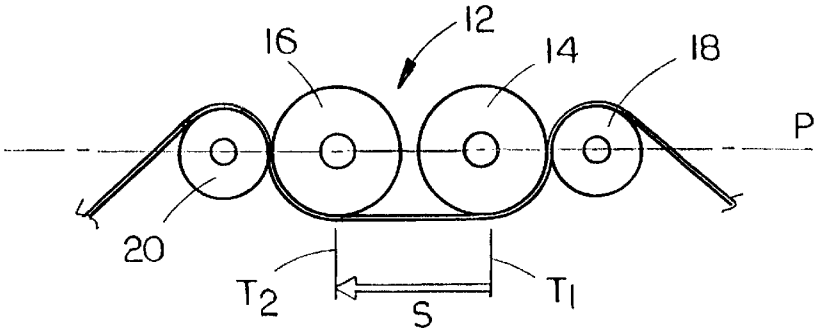
FIG. 1B (PRIOR ART)
FIG. 1B is a schematic view of a prior art prestretch film delivery system with the rollers in a closed working position.

Referring now to the drawings, in which similar or corresponding parts are identified with the same reference numeral, and more particularly to FIG. 1A and 1B a prestretch roller assembly is designated generally at 12 with a pair of upstream and downstream driven rollers 14 and 16, having equal diameters, and a pair of idler rollers 18 and 20. Roller assembly 12 is shown in FIG. 1B in the closed, or working position, with the axes of all four rollers 14, 16, 18, and 20 being coplanar.

FIG. 1A shows the roller assembly 12 in the open position, with idler rollers 18 and 20 swung out of alignment with driven rollers 14 and 16 such that the film web 22 passes in a straight line between the pair of driven rollers 14 and 16 and the idler rollers 18 and 20. As the idler rollers are pivoted back to the closed position, the film web will wrap around an upper half of the idler rollers 18 and 20, and around a lower portion of driven rollers 14 and 16, as shown in FIG. 1B. This orientation of rollers provides a stretch distance S along the film web 22 between a tangent T1 of upstream driven roller 14, and a tangent T2 of downstream driven roller 16. It can be seen that the tangents T1 and T2 are perpendicular to the plane of the roller axes identified generally by broken line P.

Figure 2A:
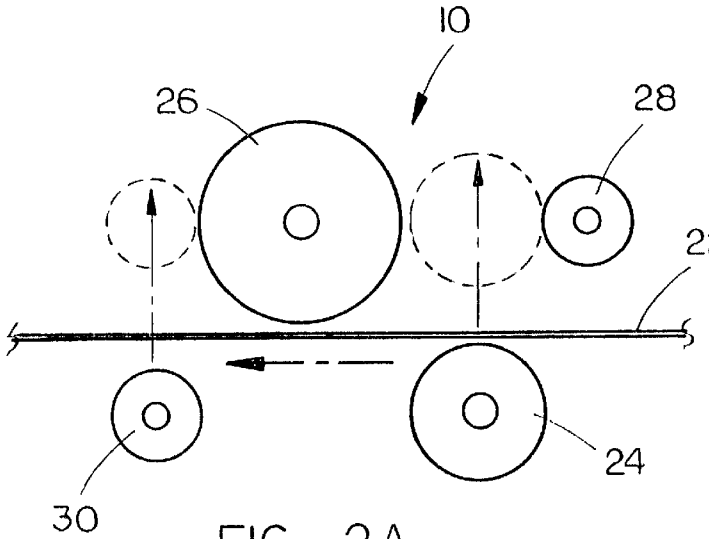
FIG. 2A is a schematic view of the prestretch film delivery system of the present invention with the rollers in the open threading position.
Figure 2B:
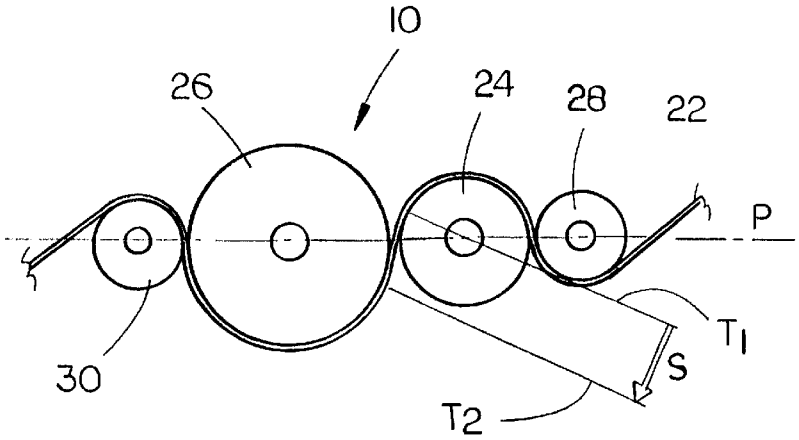
FIG. 2B is a schematic view of the prestretch film delivery system of the present invention with the rollers in the closed, working position.

Referring now to FIGS. 2A and 2B, the prestretched roller assembly of the present invention is designated generally at 10 and includes an upstream driven roller 24, a downstream driven roller 26 and a pair of idler rollers 28 and 30, all of the rollers 24, 26, 28, and 30 having axes in plane P when in the working position shown in FIG. 2B.

As shown in FIG. 2A, upstream driven roller 24 and downstream idler roller 30 are pivoted to the open position through which film web 22 is threaded. In this way, when rollers 24 and 30 are moved back to the working position of FIG. 2B, film web 22 will wrap around the under side of upstream idler roller 28, then over the upper half of upstream driven roller 24, thence under the lower half of downstream driven roller 26, and finally over the upper half of the downstream idler roller 30. The important section of this arrangement is the S-shaped pattern taken by stretch film web 22 as it extends around the upper half of the upstream driven roller and thence around the lower half of the downstream driven roller. Because of this orientation, upstream roller 24 rotates in a direction opposite that of downstream roller 26. In addition, it can be seen that the stretch distance S between tangent T1 of the upstream driven roller 24 and tangent T2 of the downstream driven roller 26 is much shorter than the stretched distance S of the prior art arrangement shown in FIG. 1B. This is because the tangents are oriented at an acute angle relative to the plane P, rather than perpendicularly to the plane P, as is the case with the prior art orientation of FIG. 1.

Figure 4:
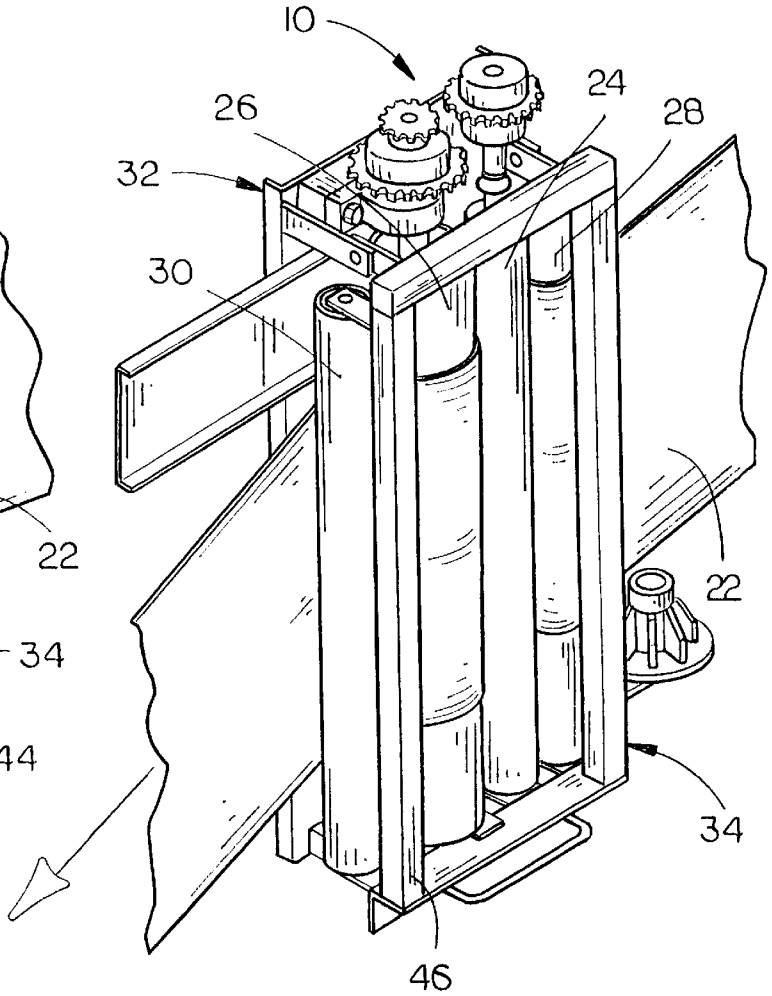
FIG. 4 is a perspective view similar to FIG. 3, but with the assembly in the closed working position.
Figure 3:
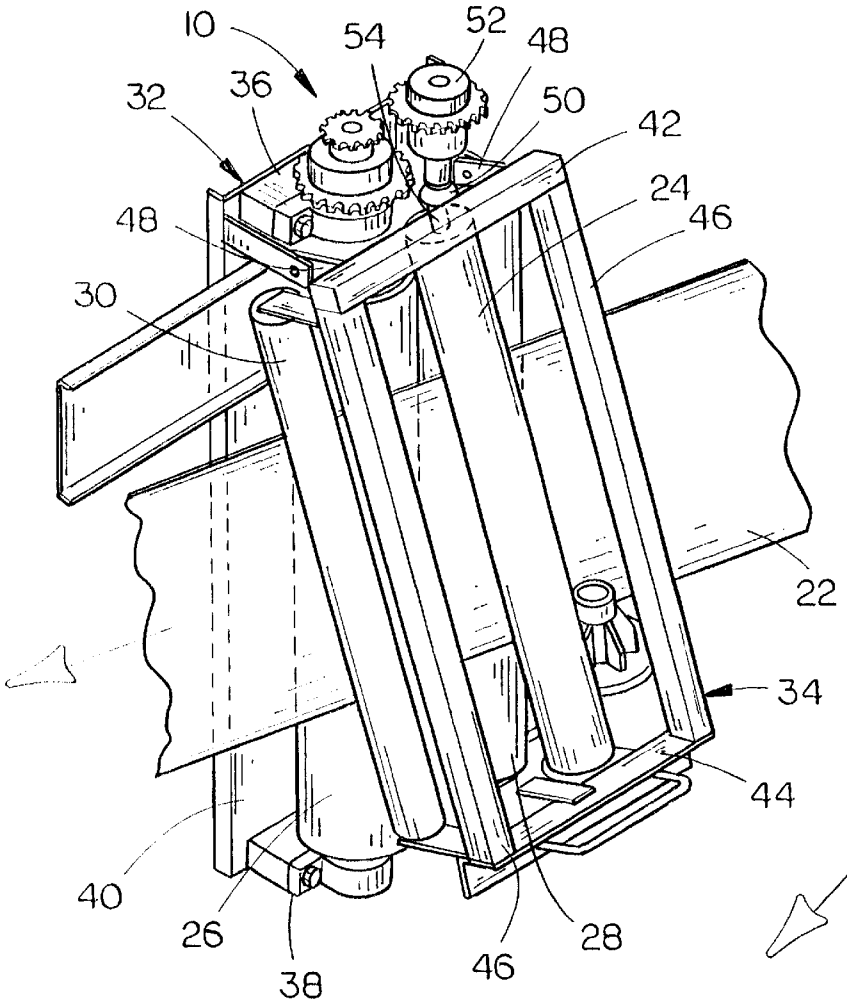
FIG. 3 is a perspective view of the prestretch roller assembly of the film delivery system of the present invention, with the assembly in the open position.
Figure 5:
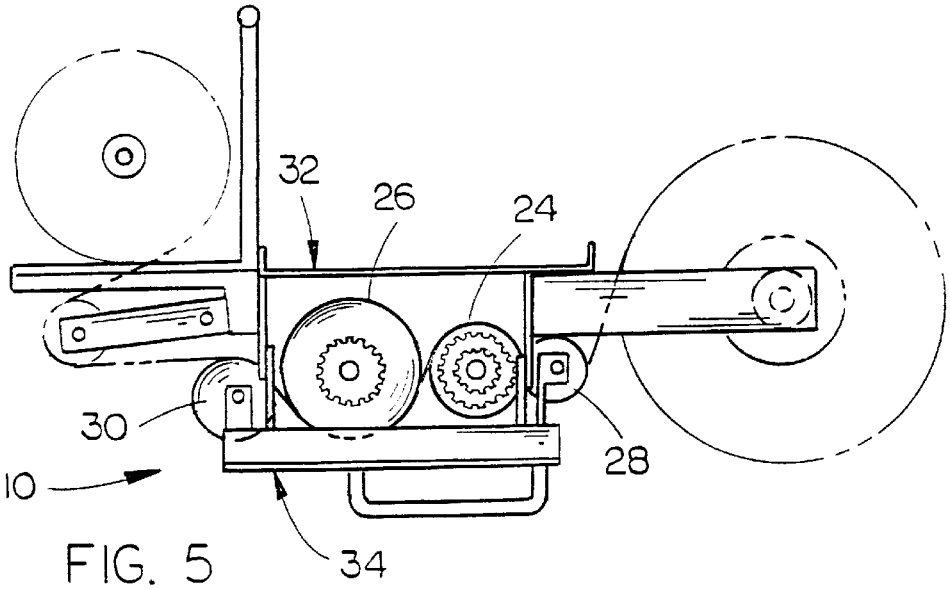
FIG. 5 is a top view of the assembly shown in conjunction with a supply of film and an object to be wrapped.
Figure 6:
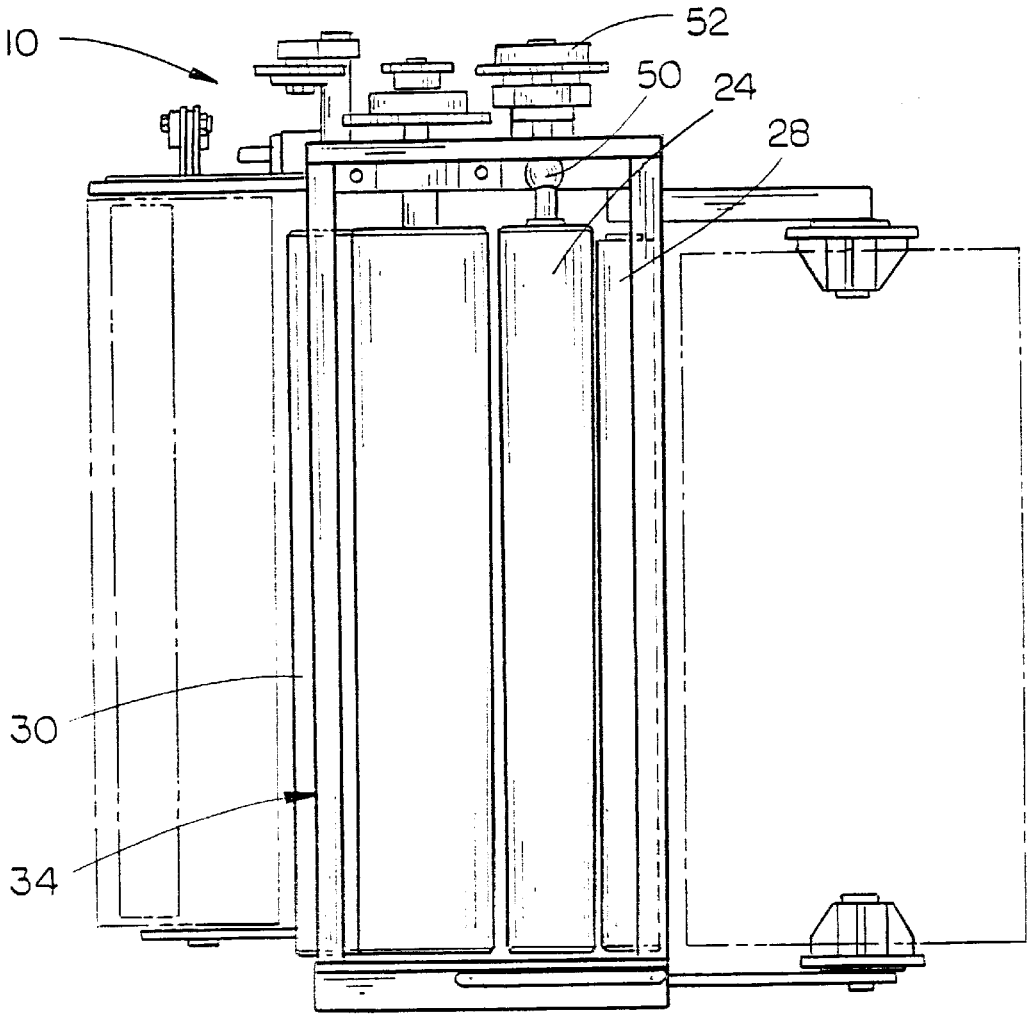
FIG. 6 is a front view of the assembly of FIG. 5.

Referring now to FIGS. 3 and 4, it can be seen that roller assembly 10 includes a stationary frame 32, supporting rollers 26 and 28, and a swing frame 34 supporting rollers 24 and 30. Stationary frame 32 includes a pair of opposing first and second end brackets 36 and 38, mounted in parallel spaced apart relation by a base plate 40. The upstream idler roller 28 and downstream driven roller 26 are rotatably mounted between end brackets 36 and 38.

Figure 7:
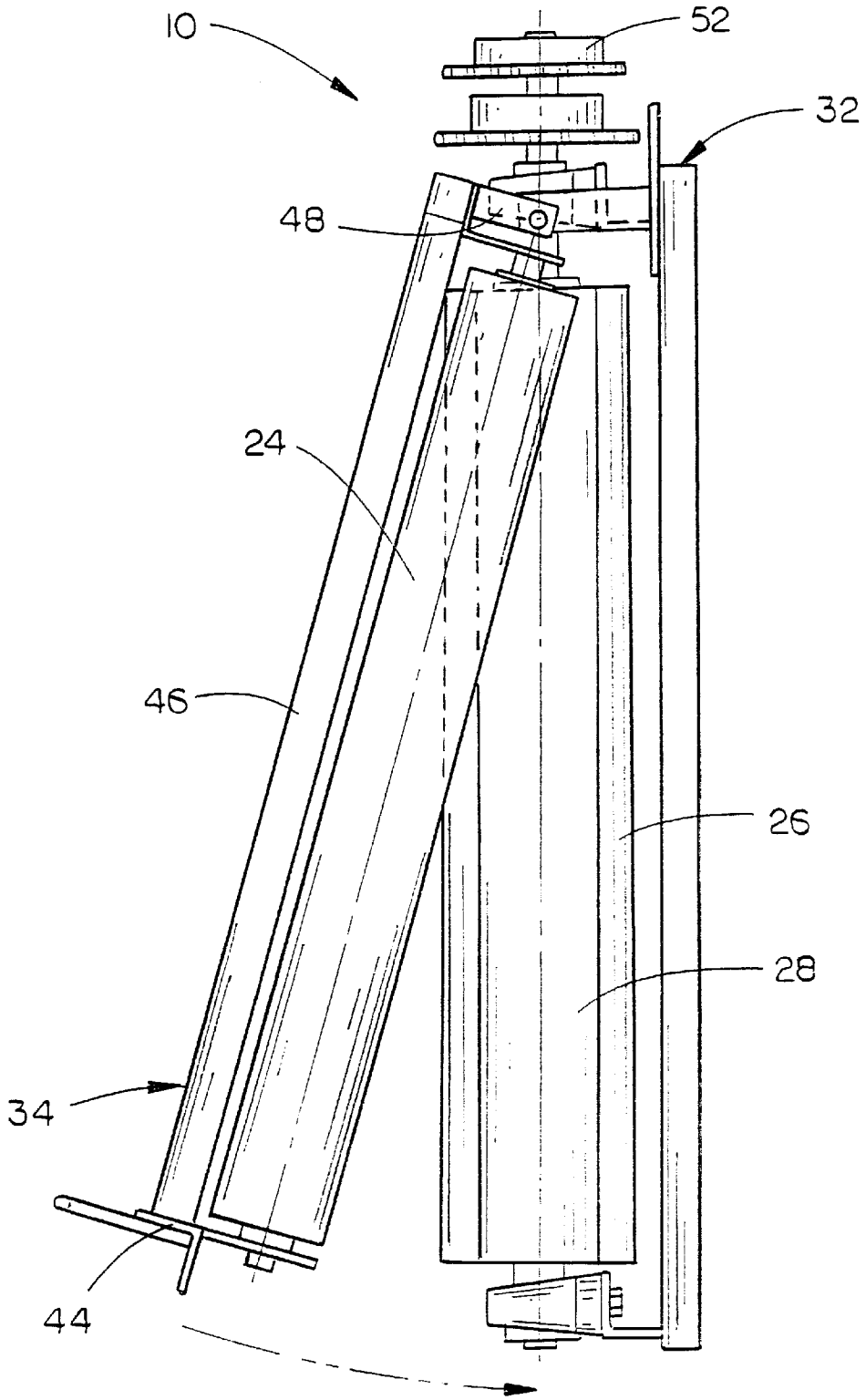
FIG. 7 is a side view illustrating the assembly in an open position.

Swing frame 34 includes a first end member 42, a second end member 44, and a pair of cross-members 46. A pair of legs 48 project from first end member 42 and are pivotally connected at their projecting ends to the first end bracket 36, such that the second end member 44 will swing away from the stationary frame 32 when swing frame 34 is pivoted. A latch (not shown) will retain the swing frame 34 in the working position shown in FIG. 7, with the axes of all of the rollers coplanar. In order to permit drive roller 24 to swing with swing frame 34, a U-joint 50 is provided between the drive sprocket 52 and the drive shaft 54 for drive roller 24. The opposite end of drive shaft 54 is rotatably mounted to a depending leg on second end 44 of swing frame 34. Similarly, idler roller 30 is spaced downwardly on a pair of depending legs from swing frame 34, such that rollers 24 and 30 will pivot to a position with their axes coplanar with the axes of rollers 26 and 28 when in the working position of FIG. 7.

In operation, it can be seen that the prestretch roller assembly 10 achieves elongation of the stretch film with less neck down due to the reduced stretch distance, facilitated by the "S" film web path around the drive rollers. This also increases the reliability of the system by allowing slight film imperfections to pass through the system without causing a film failure. Enhanced film traction is achieved by the increased amount of surface contact by the film web around the drive rollers, which results in virtually no loss of theoretical elongation.

Although the drawings illustrate that roller 26 has a greater diameter than roller 24, rollers 26 and 24 could have equal diameters if desired or roller 24 can have a greater diameter than roller 26.

Whereas the invention has been shown and described in connection with the preferred embodiment thereof, many modifications, substitutions and additions may be made which are within the intended broad scope of the appended claims.

I claim:

1. A prestretch roller assembly for a film delivery system, comprising:

upstream and downstream prestretch drive rollers, each rotatable about an axis, for engaging and stretching stretch film material;

a web of stretch film extending around an upper portion of the upstream drive roller and thence directly to a lower portion of the downstream drive roller to form a generally S-shaped path;

two idler rollers, one of said two idler rollers being positioned downstream of said downstream drive roller and rotatable about an axis for engaging the stretch film material, the other of said two idler rollers being positioned upstream of said upstream drive roller and rotatable about an axis for engaging the stretch film material, the axes of the drive rollers and the idler rollers being coplanar; and drive means connected to the drive rollers for driving the rollers in opposite directions.

2. The assembly of claim 1, wherein the upstream drive roller has a smaller diameter than the downstream drive roller.

3. The assembly of claim 1 wherein said upstream roller has the same diameter as said downstream roller.

4. A prestretch roller assembly for a film delivery system, comprising:

upstream and downstream prestretch drive rollers for engaging and stretching stretch film material:

a web of stretch film extending around an upper portion of the upstream drive roller and thence directly to a lower portion of the downstream drive roller to form a generally S-shaped path; and drive means connected to the drive rollers for driving the rollers in opposite directions;

the downstream drive roller being rotatably mounted on a stationary frame and the upstream drive roller having first and second ends, said first end connected to the stationary frame, and said second end mounted on a swing frame pivotable about an axis orthogonal to the axes of the drive rollers and intersecting both drive roller axes.

5. The assembly of claim 4, wherein the upstream drive roller includes a coaxial drive shaft extending therethrough and projecting outwardly from the ends, the drive shaft having a universal joint therein located at the intersection of the upstream drive roller axis and the swing frame pivot axis.

6. The assembly of claim 5, further comprising:

a downstream idler roller rotatably mounted on the swing frame for pivotal movement therewith, and having an axis coplanar with the drive roller axes when the swing frame is pivoted to a closed position;

said downstream idler roller in parallel abutting contact with the downstream drive roller when the swing frame is in the closed position;

said stretch film web directed around an upper portion of the downstream idler roller after leaving the downstream drive roller.

7. The assembly of claim 6, further comprising:

an upstream idler roller rotatably mounted on the stationary frame with an axis coplanar with the axes of the downstream drive roller and with the upstream drive roller and downstream idler roller when the swing frame is in the closed position;

said upstream idler roller in parallel abutting contact with the upstream drive roller when the swing frame is in the closed position;

said film web directed around a lower portion of the upstream idler roller prior to engaging the upper portion of the upstream drive roller.

8. A prestretch roller assembly for a film delivery system, comprising:

upstream and downstream prestretch drive rollers for engaging and stretching stretch film material, the upstream drive roller having a smaller diameter than the downstream drive roller;

a web of stretch film extending around an upper portion of the upstream drive roller and thence directly to a lower portion of the downstream drive roller to form a generally S-shaped path;

drive means connected to the drive rollers for driving the rollers in opposite directions; and the downstream drive roller being rotatably mounted on a stationary frame and the upstream drive roller having first and second ends, said first end connected to the stationary frame, and said second end mounted on a swing frame pivotable about an axis orthogonal to the axes of the drive rollers and intersecting both drive roller axes.

9. The assembly of claim 8, wherein the upstream drive roller includes a coaxial drive shaft extending therethrough and projecting outwardly from the ends, the drive shaft having a universal joint therein located at the intersection of the upstream drive roller axis and the swing frame pivot axis.

10. The assembly of claim 9, further comprising:

a downstream idler roller rotatably mounted on the swing frame for pivotal movement therewith, and having an axis coplanar with the drive roller axes when the swing frame is pivoted to a closed position;

said downstream idler roller in parallel abutting contact with the downstream drive roller when the swing frame is in the closed position;

said stretch film web directed around an upper portion of the downstream idler roller after leaving the downstream drive roller.

11. The assembly of claim 10, further comprising:

an upstream idler roller rotatably mounted on the stationary frame with an axis coplanar with the axes of the downstream drive roller and with the upstream drive roller and downstream idler roller when the swing frame is in the closed position;

said upstream idler roller in parallel abutting contact with the upstream drive roller when the swing frame is in the closed position;

said film web directed around a lower portion of the upstream idler roller prior to engaging the upper portion of the upstream drive roller.

* * * * *